United States Patent [19]

McClellan et al.

[11] Patent Number: 4,513,267

[45] Date of Patent: Apr. 23, 1985

[54] STATIONARY CONTACT STRAP TO ACHIEVE A CURRENT LIMITING BLOW-OFF EFFECT

[75] Inventors: David P. McClellan, Westminster; Frank W. Kussy, Randallstown, both of Md.

[73] Assignee: Siemens-Allis, Inc., Atlanta, Ga.

[21] Appl. No.: 479,367

[22] Filed: Mar. 28, 1983

[51] Int. Cl.[3] ..... H01H 77/02

[52] U.S. Cl. ..... 335/16; 335/195; 335/196

[58] Field of Search ..... 335/16, 147, 195, 196; 200/275; 339/256 S, 258 S

[56] References Cited

U.S. PATENT DOCUMENTS

| | | | |
|---|---|---|---|
| 3,092,699 | 6/1963 | Latour | 335/16 |
| 3,559,119 | 1/1971 | Koennecke et al. | 335/16 |
| 3,663,905 | 5/1972 | Kussy et al. | 335/195 |
| 3,921,109 | 11/1975 | Hodgson | 335/195 |
| 4,001,738 | 1/1977 | Terracol et al. | 335/16 |
| 4,023,885 | 5/1977 | Snowdon et al. | 335/196 |

*Primary Examiner*—E. A. Goldberg
*Assistant Examiner*—George Andrews
*Attorney, Agent, or Firm*—F. W. Powers; J. L. James

[57] ABSTRACT

A so-called blow-off type current limiting circuit breaker includes a stationary contact strap that is divided into three elongated closely spaced coplanar parallel arms that are connected to each other at one end of the strap. The stationary contact is mounted to the interior one of the parallel arms at the end thereof remote from the one end of the strap. A terminal portion of the strap connects exterior ones of the parallel arms to one another at the ends thereof remote from the one end of the strap. A movable contact engageable with and disengageable from the stationary contact is mounted to one end of a movable contact arm that is pivoted at its opposite end in the region of the one end of the strap, extending parallel to the arms of the strap and being aligned with the interior arm. Current in the interior arm flows in a direction opposite to the direction of current flow in the exterior arms and the movable contact arm. With the contact engaged, the interior arm and the movable contact arm are very close to one another so that upon the occurrence of severe fault current conditions, repelling electrodynamic forces of sufficient magnitude are developed between the movable contact arm and the interior arm to separate the contacts very rapidly, thereby limiting the magnitude of the fault current to a value within the rating of the circuit breaker.

12 Claims, 13 Drawing Figures

STATIONARY CONTACT STRAP TO ACHIEVE A CURRENT LIMITING BLOW-OFF EFFECT

This invention relates to current limiting molded case circuit breakers in general and more particularly relates to a stationary contact strap for achieving contact blow-off under severe fault current conditions.

For molded case circuit breakers connected in circuits that are capable of delivering relatively high currents, say 50,000 amps at 480 volts, conventional spring powered trip-free contact operating mechanisms do not respond quickly enough to prevent permanent damage to the circuit breaker when it is subjected to severe fault current conditions. Because of this, the prior art has provided circuit breaker constructions in which electrodynamic blow-off forces developed as a result of severe fault currents will act to separate the circuit breaker contacts even before typical overload current sensing devices release the contact operating mechanism for opening the circuit breaker. In effect, fast separation of the circuit breaker contacts as a result of electrodynamic forces serves to limit the magnitude of the fault current to a value that will not cause permanent damage to the circuit breaker. Examples of this type of current limiting circuit breaker is found the B. DiMarco and A. J. Kralik copending U.S. Patent Application (RMD-1104) Ser. No. 256,305, filed Apr. 23, 1981, entitled "Electromagnetically Actuated Anti-Rebound Latch", and in U.S. Pat. No. 3,593,227, issued July 13, 1967 to G. F. Mitskevich et al for "Automatic Electrodynamic Blowoff Breaker With Stationary Contact Form Of Two Series Wound U-Shaped Member".

For the most part, electrodynamic blowoff effects relied upon by the prior art are achieved by mounting the stationary contact to a rigid conductor that extends parallel to the movable contact arm and is adjacent thereto when the contacts are closed. With this arrangement, currents in the conductor and arm flow in opposite directions thereby generating a repelling force which acts to move the contact arm away from the conductor, thereby opening the circuit breaker.

Typically, in prior art electrodynamic type current limiting circuit breakers having housings of moderately high profile with line and load contacts at opposite ends of the housing, the conductor on which the stationary contact is mounted is folded back on itself to form two legs, one behind the other, as in the aforesaid U.S. Pat. No. 3,593,227. The stationary contact is mounted to the forward leg and the cooperating movable contact is positioned forward of the forward leg. This arrangement substantially increased the height of the circuit breaker housing or resulted in a reduction in the number of arc extinguishing plates in the arc chute.

In another prior art current limiting blow-off contact construction, that illustrated in U.S. Pat. No. 4,135,135, issued Jan. 16, 1979, to T. J. Rys for "Resilient Anti-Rebound Latch for Circuit Breaker Contacts", even though the line and load terminals are at opposite ends of the housing, the stationary contact member is not folded back on itself, but the overall construction results in a circuit breaker housing profile that is relatively high and the number of plates in the arc chute is severely limited.

In order to overcome the aforesaid drawbacks of the prior art and obtain a molded case circuit breaker having a low profile housing with line and load terminals at opposite ends thereof, the instant invention provides a stationary contact strap or mounting member that is divided into a plurality of parallel co-planar arms to achieve a relatively low profile. That is, the stationary contact strap is stamped from a conducting sheet to form a central conductor and outer conductors lying along opposite edges of the central conductor and closely spaced therefrom. The stationary contact is mounted to one end of the central conductor and the other end of the central conductor is connected to the outer conductors. The ends of the outer conductors in the vicinity of the stationary contact are connected together at a terminal portion adapted for connection to an external circuit. Currents entering the terminal portion divide, flow through the outer conductors and then combine to flow through the central conductor to the contacts.

This provides an electrodynamic blow-off effect in that oppositely directed currents flow in the central conductor and the movable contact arm. Currents flowing in the outer conductors are in the same direction as current flow in the contact arm, thereby creating attracting forces between the contact arm and the outer conductor. However, because of increased spacing between the contact arm and outer conductors as compared to the spacing between the former and the central conductor, these attracting forces are not of sufficient magnitude to adversely affect current limiting blow-off operation.

Accordingly, the primary object of the instant invention is to provide a novel improved current limiting circuit breaker that has a relatively shallow housing with line and load terminals at opposite ends of the housing.

Another object is to provide a novel stationary contact means for a blow-off type current limiting circuit breaker.

Still another object is to provide a current limiting circuit breaker in which the stationary contact strap includes a plurality of closely spaced parallel coplanar arms in a plane perpendicular to the plane of movement for the movable contact arm.

These objects, as well as other objects of this invention shall become readily apparent after reading the following description of the accompanying drawings, in which.

FIGS. 9*a* through 9*e* are side elevations of the movable contact arm in different positions thereof. In FIG.

Figure 9A:
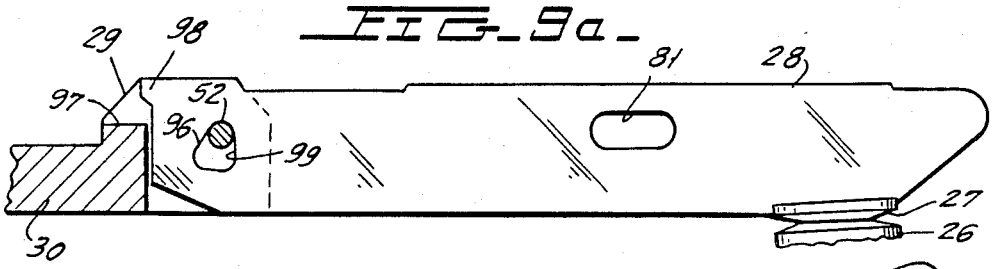
Figure 9B:
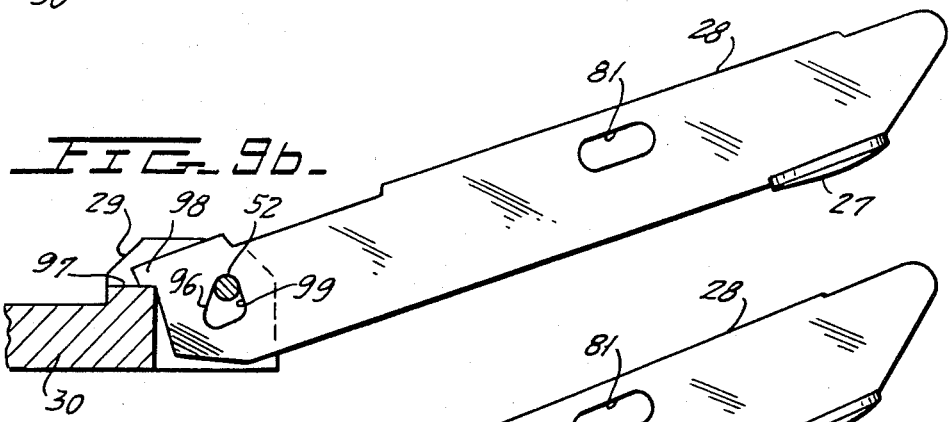
Figure 9C:
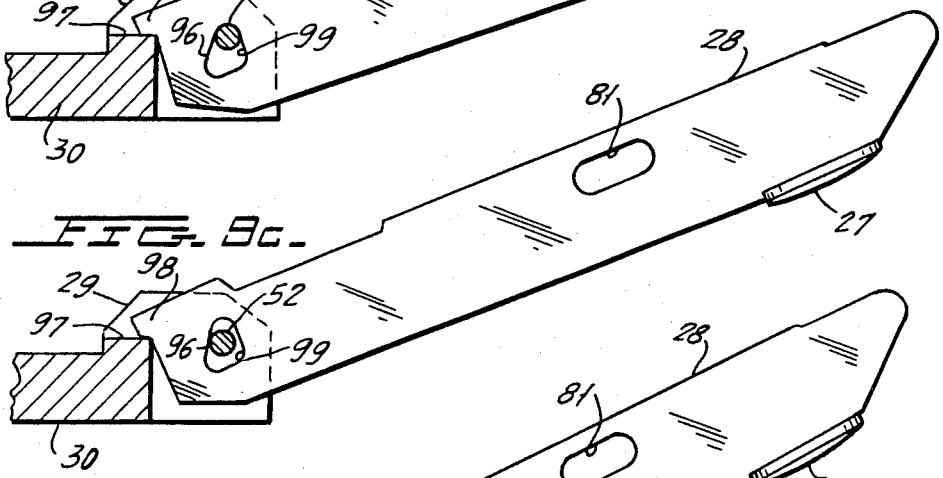
Figure 9D:
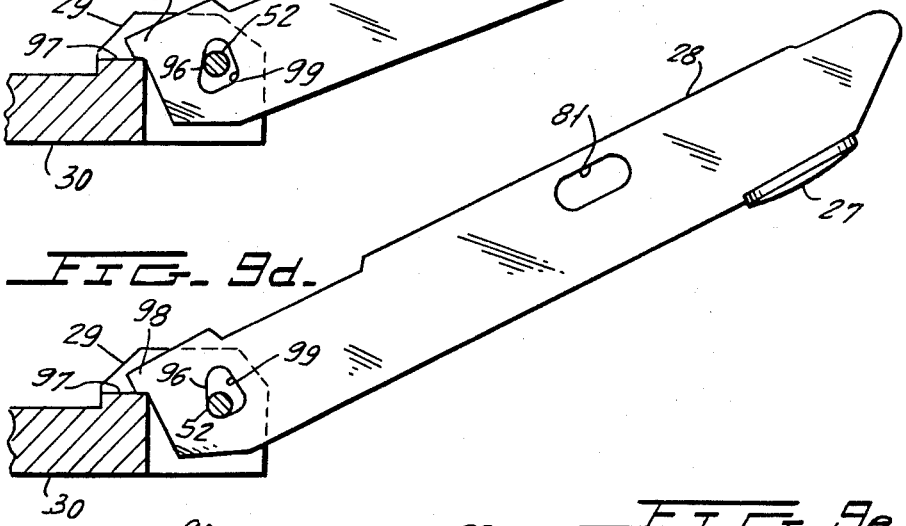
Figure 9E:
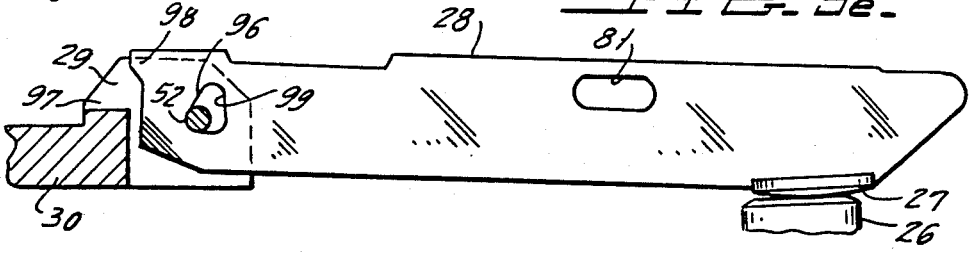

9*a* the contact arm is fully closed, in FIGS. 9*b* and 9*c* the contact arm is shown moving progressively toward the full open position of FIG. 9*d*, and in FIG. 9*e* the contact arm is shown in its position of initial engagement between the movable and stationary contacts.

Now referring to the Figures. Circuit breaker 10 is a three-pole unit disposed within a molded insulated housing consisting of shallow base 11 and removable front cover 12 which mate along line 14. Partitions 16, 17 in base 11 extend parallel to sides 18, 19 thereof to divide base 11 into three side-by-side, longitudinally extending compartments each of which contains the current carrying elements of an individual pole. In a manner well known to the art, the center compartment formed between partitions 16, 17 also houses a common trip-free, overcenter toggle type contact operating mechanism 15 which, as will hereinafter be seen, acting through transverse insulating tie bar 21 simultaneously opens and closes all poles of circuit breaker 10 during manual operation and simultaneously opens circuit breaker 10 upon the occurrence of predetermined moderate overloads and moderate short circuits.

Figure 1:
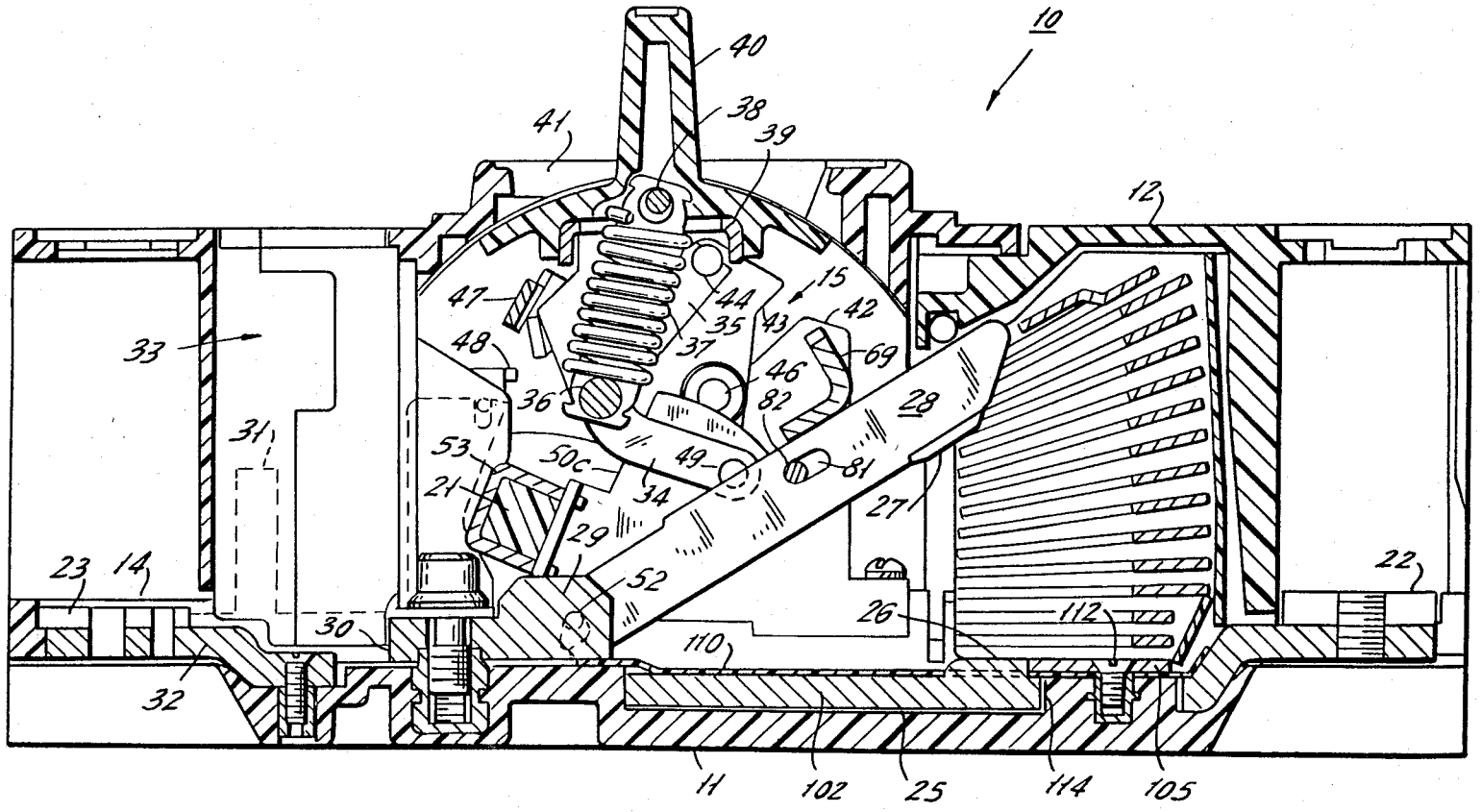
FIG. 1 is a longitudinal cross-section of a molded case circuit breaker that embodies the teachings of the instant invention.
Figure 2:
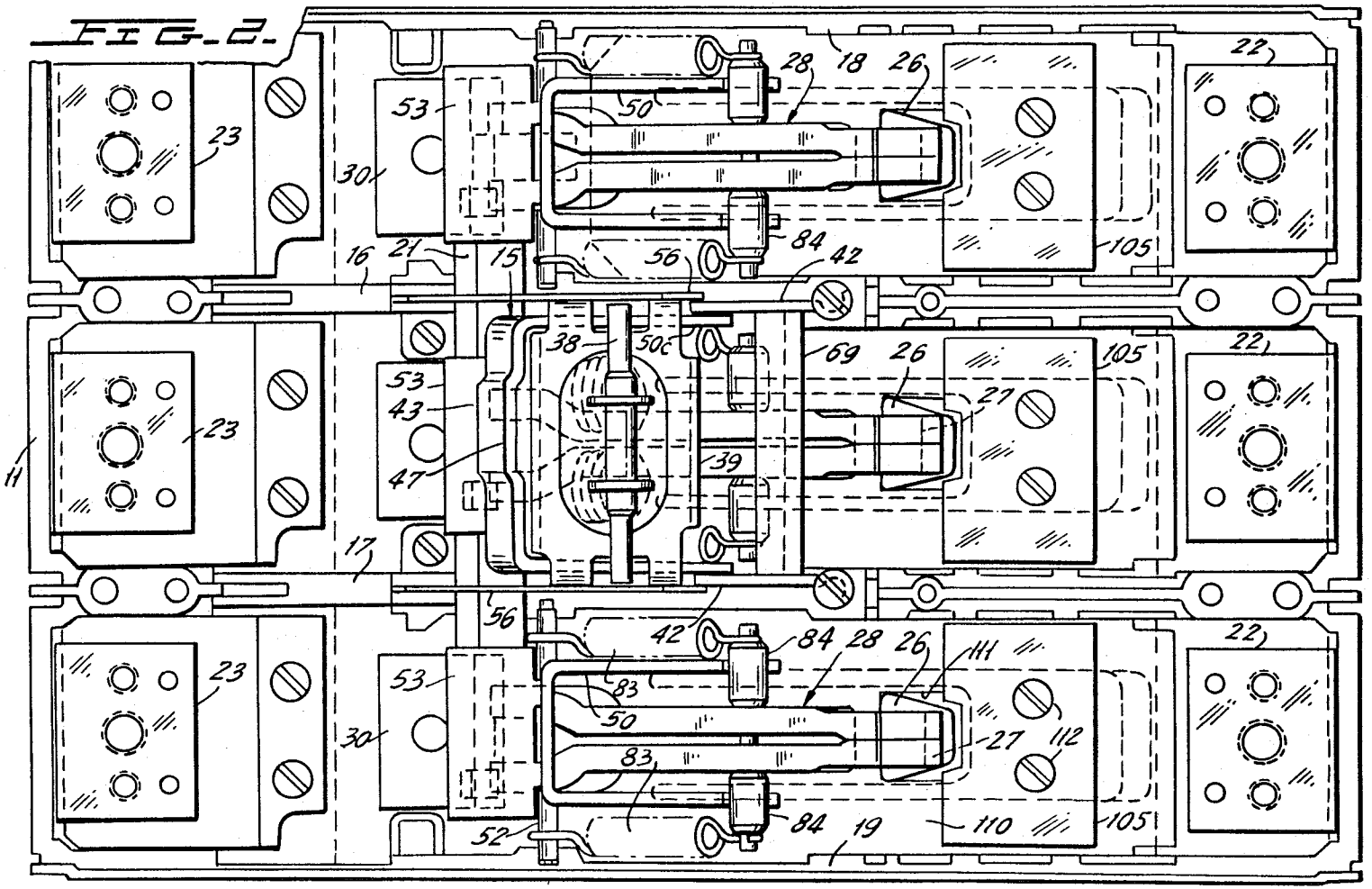
FIG. 2 is a plane view of the circuit breaker of FIG. 1 with the arc chutes, automatic overload trip unit, housing cover and manual operating handle removed to better reveal other elements of the circuit breaker.

Since the current carrying elements of all three poles are essentially identical, the current carrying elements of only one pole shall be described herein with particular reference to FIG. 1. That is, the current path between line terminal 22 and load terminal 23 located at opposite ends of housing 11, 12 comprises terminal strap 25 (FIG. 3), stationary contact 26, movable contact 27, movable contact arm 28, conducting support 29, terminal strap 30 formed integrally with support 29, conducting element 31 (typically a bimetal heater extending through overload current sensing automatic trip unit 33), and strap 32 having load terminal 23 mounted thereon.

Figures 6, 7, 8:
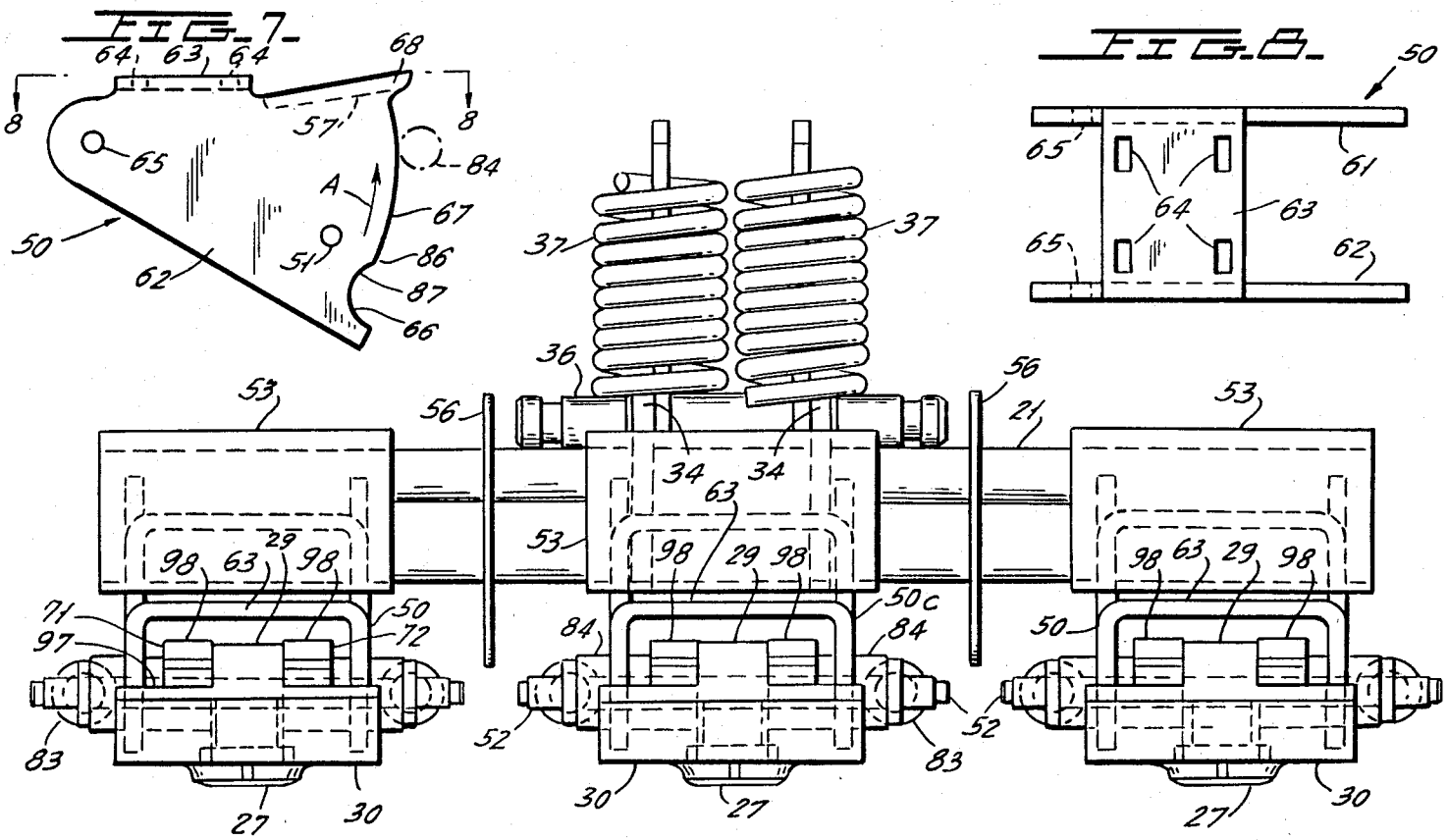
FIG. 6 is an elevation of the elements in FIG. 4, looking in the direction of arrows 6—6.
FIG. 7 is a side elevation of the drive means element for the movable contact arm.
FIG. 8 is an end view of the drive means element, looking in the direction of arrows 8—8 of FIG. 7.

The toggle portion of contact operating mechanism 15 includes lower link 34 and upper link 35 pivotally connected at knee 36. Coiled tension springs 37 are connected between knee 36 and transverse pin 38, the latter being supported by and movable with operating member 39 having insulating handle extension 40 projecting forward of cover 12 through opening 41 therein. A fixed pivot (not shown) on mechanism frame 42 pivotally supports operating member 39. The end of upper toggle link 35 remote from knee 36 is mounted to latchable cradle 43 at pivot 44. Cradle 43 is mounted on frame 42 at pivot 46 and is pivotable about the latter in a counterclockwise direction as viewed in FIG. 1 to bring cradle latching formation 47 into engagement with releasable latch 48 that projects from trip unit 33. The end of lower toggle link 34 remote from knee 36 is connected by pivot 49 to drive means 50*c* at aperture 51 thereof (FIG. 7). At a point remote from pivot 49 drive means 50*c* is pivotally mounted on pin 52 that also provides a pivotal connection between movable contact arm 28 and support 29. When toggle 34, 35 is extended as in FIG. 4, drive means 50*c* is in its Closed position and when toggle 34, 35 is collapsed as in FIG. 1, drive means 50*c* is pivoted counterclockwise about pivot 52 to its Open position of FIG. 1.

U-shaped clamp 53 connects drive means 50*c* to tie rod 21 at the center thereof. Each of the outer poles is provided with a drive means 50, the difference between drive means 50*c* and 50 is that the former does not have the shaded portion bounded by dash line 57 in FIG. 7 and aligned apertures 51 of the latter are not utilized. In each of the outer poles, drive means 50 is secured to tie rod 21 outboard of drive means 50*c*. In a manner well known to the art, transverse bar 21 extends through cut-aways in housing partitions 16, 17 that provide large enough apertures for free movement of bar 21 as drive means 50*c* and 50 pivot between their Open and Closed positions. These partition openings are otherwise covered by insulating sheets 56 mounted on bar 21 and movably positioned adjacent partitions 16, 17.

For the most part, drive means 50*c* and 50 are identical so that only the latter will be described in detail. That is, drive means 50 is a generally U-shaped member having parallel arms 61, 62 connected by web 63 having apertures 64 which receive gripping ears (not shown) extending from clamp 53. Each of the arms 61, 62 is identical so that only arm 62 will be described in detail. Arm 62 includes aperture 65 through which contact arm pivot pin 52 extends. The edge of arm 62 remote from aperture 65 is provided with cam depression 66 and relatively long cam formation 67 adjacent to depression 66. At the end of formation 67 the edge having cam formation 66, 67 is provided with protrusion 68 which, in a manner to be hereinafter explained, limits opening motion of each outer pole contact arm 28 during blowoff. Opening movement of contact arm 28 in the center pole is limited by engagement of that arm 28 with transverse element 69 (FIG. 1) of mechanism frame 42.

Figures 3, 4, 5:
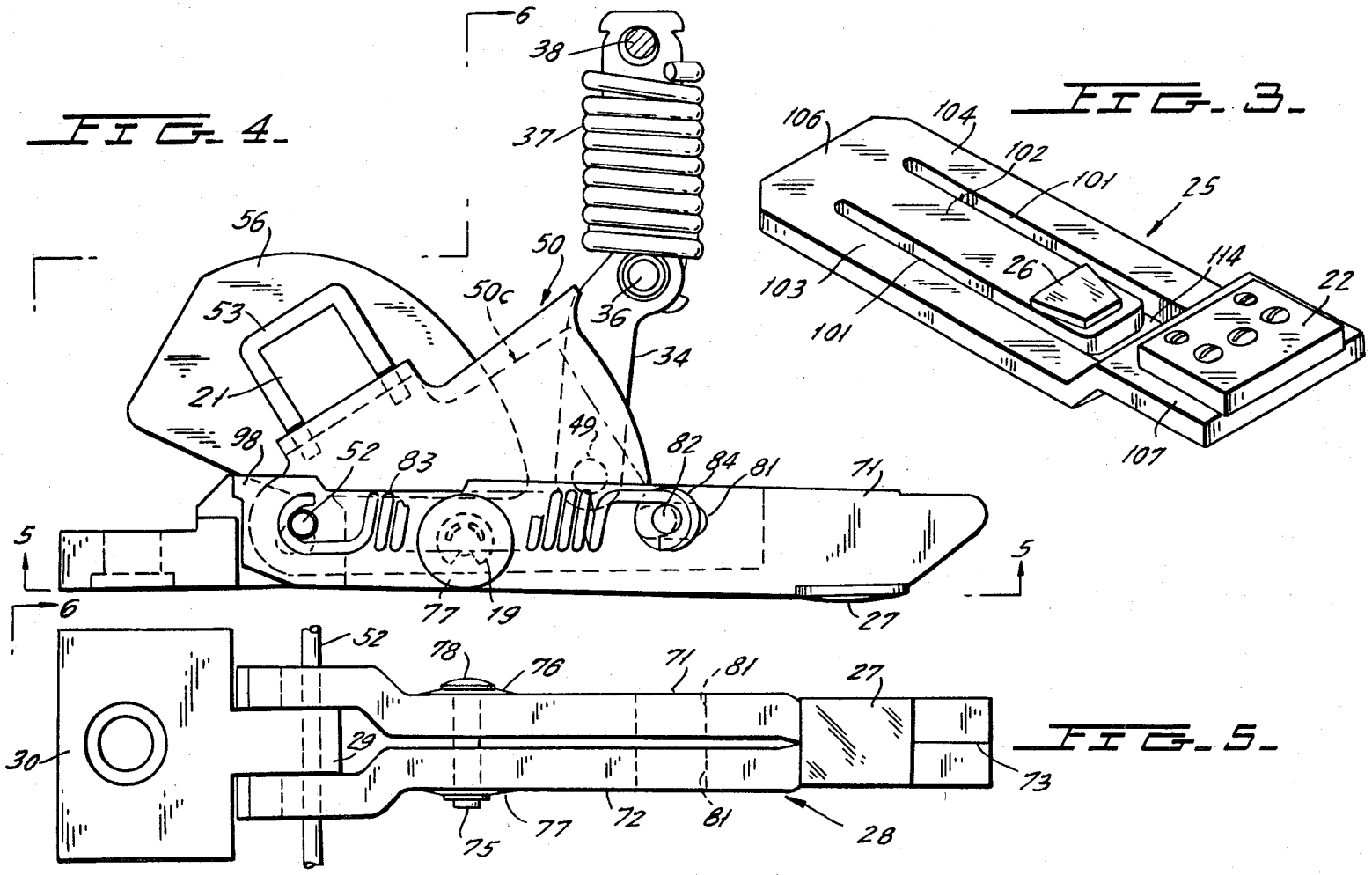
FIG. 3 is a perspective of the conducting strap on which the stationary contact is mounted.
FIG. 4 is a side elevation of the movable contact arm and selected elements in operative engagement therewith.
FIG. 5 is a bottom view of the movable contact arm and its support, looking in the direction of arrows 5—5 of FIG. 4.

As seen best in FIG. 5, movable contact arm 28 includes elongated parallel conducting sections 71, 72 that are closely spaced at the major central portions thereof. At the end of arm 28 having movable contact 27, sections 71, 72 are offset inwardly to abut one another and are firmly secured together as by brazing. At the end of arm 28 remote from contact 27, sections 71, 72 are offset outwardly and receive support 29 therebetween. Sections 71, 72 are biased toward one another by spring washers 76, 77 which lie against opposite sides of arm 28 and are mounted on pin 75 that extends through aligned apertures in sections 71, 72. Head 78 of pin 75 retains spring washer 76 and snap-on clip 79 is received in an annular depression near the end of pin 75 remote from head 78 to retain spring washer 77. The biasing force provided by spring 76, 77 acts to assure firm contact between sections 71, 72 and support 29 regardless of the angular position of contact arm 28.

Currents flowing in sections 71 and 72 of movable contact arm 28 are in the same direction, thereby generating an attracting force which aids the biasing forces generated by spring washers 76, 77. This electrodynamic attracting force is especially stronger in the extensive closely spaced central region between sections 71 and 72. As current flow increases, this electrodynamic force increases and serves to offset the blowoff forces at the interfaces between support 29 and sections 71, 72, with these blowoff forces increasing as current flow increases.

Sections 71, 72 are also provided with aligned longitudinally extending elongated slots 81 through which transverse pin 82 extends. Along the outboard side of each section 71, 72 is a coiled tension spring 83 secured to pivot pin 52 and transverse pin 82. Disposed between spring 83 and each of the sections 71, 72 is a cylindrical cam follower roller 84. Springs 83 bias cam followers 84 toward contact arm pivot 52 and against the surfaces of drive means 50 having cam formations 66, 67.

Under normal operating conditions, followers 84 are in depressions 66 so that as drive means 50 is operated between its Open and Closed positions, contact 26, 27 will be disengaged and engaged, respectively. However, with contacts 26, 27 engaged, if severe overload current conditions occur, electrodynamic forces acting to separate contacts 26, 27 will move contact arm 28 to its Open position of FIG. 1 before drive means 50 has an opportunity to move from its Closed position toward its Open postition. When this occurs, initial movement of contact arm 27 in the circuit opening direction moves followers 84 in the upward direction with respect to FIG. 4 until they leave the cam depressions 66 and arrive at convex cam formations 67. The boundary 86 (FIG. 7) between cam formations 66, 67 is the overcenter position for contact arm 28. That is, when cam follower 84 moving in the contact opening direction indicated by arrow A in FIG. 7 leaves cam depression 66 and moves past point 86, the action of spring 83 biases follower 84 in the direction of arrow A. The curvature of cam formation 67 may be chosen so that for initial movement of follower 84 after it leaves cam depression 66, movement will be rapid. Such movement will slow somewhat as follower 84 approaches protrusion 68 so that by the time follower 84 engages protrusion 68, even though it is being biased in the opening position indicated by arrow A, there is no danger that they will move beyond protrusion 68. In addition, the deceleration of follower 84 is such that there is no danger of contact arm 28 rebounding toward closed circuit position after being driven to open circuit position by electrodynamic forces which accompany severe overload currents. Subsequent movement of drive means 50 to its Open postition will cause relative movement between drive means 50 and contact arm 28 to bring follower 84 into cam depression 66.

For the most part, cam follower 84 is normally seated in the deepest portion of cam pocket 66. This condition exists during closing movement of contact arm 28, up to the point where there is initial engagement of movable contact 27 with stationary contact 26. However, drive means 50 continues to move in the closing direction (clockwise with respect to FIG. 1) and by so doing, follower 84 is engaged by section 87 of cam depression 66. This forces transverse pin to move slightly away from pivot 52 thereby additionally tensioning springs 83. Even though the line of action of springs 83 is generally longitudinal with respect to contact arm 28, the angular relationship between cam surface portion 87 and follower 84 results in a relatively strong component of force in the contact closing direction.

The shape of cam section 67 is tailored so that during electrodynamic blowoff, as soon as follower 84 moves beyond 86, contact arm 28 is effectively in an overcenter position in the circuit opening direction. It is seen that this latter condition is achieved after relatively little movement of contact arm 28 in the opening direction.

Electrodynamic blowoff forces which open circuit breaker 10 during severe fault current conditions result from interactions of the magnetic fields that accompany currents flowing in contact arm 28 and stationary contact strap 25. The latter is stamped from conducting sheet material with the stamping process providing a generally U-shaped cutout that effectively forms three closely spaced elongated arms 102, 103, 104 that are joined by connecting section 106 at the end of strap 25 remote from line terminal 22. Terminal section 107 of strap 25 acts as a jumper between the ends of exterior arms 103, 104 remote from connecting section 106. The cross-sectional areas of exterior arms 103, 104 are essentially equal and the cross-sectional area of interior arm 102 is essentially equal to the combined cross-sectional areas of arms 103 and 104.

With circuit breaker 10 closed, movable contact arm 28, which confronts interior arm 102, is very closely spaced therefrom. The width of contact arm 28 is less than the width of interior arm 102 and the spaces between interior arm 102 and exterior arms 103, 104 are each less than the thickness of the stock from which strap 25 is stamped. Relatively stiff, flexible insulating sheet 110 is interposed between movable contact arm 28 and strap 25, covering most of the latter. Insulator 110 is provided with cutout 111 through which stationary contact 26 extends. Formations within base 11 operatively position strap 25. Arcing contact 105 acts as a clamp to retain strap 25. That is, arc runner 105 is provided with individual clearance apertures for two screws 112 that are received by threaded inserts (not shown) in base 11 after passing through the web portion 114 of U-shaped cutout 101 in strap 25, and clearance apertures in insulator 110 and arc runner 105.

Current entering strap 25 at terminal section 107 flows in the same direction through exterior arms 103, 104, through connecting section 106 and then combine and flow in the opposite direction through interior arm 102. At this time, current flow in movable contact arm 28 is in a direction opposite to the direction of current flow through interior arm 102 so that under severe fault current conditions, a very strong electrodynamic force is generated to repel movable contact arm 28, thereby moving the latter in circuit opening direction. While currents flowing in contact arm 28 and exterior arms 103, 104 are in the same direction, the attractive forces are not significant compared to the repelling forces generated between interior arm 102 and contact arm 28 because of the greater space from arm 28 to arms 103, 104 as compared to the distance between arms 28 and 102. Arm 28 is offset from arms 103 and 104 so that only the attracting components of force in the plane of motion for contact arm 28 that will oppose the repelling force. The attracting forces acting normal to the plane of motion for contact arm 28 are in equal and opposite directions, thereby producing no net effect.

Now referring particularly to FIGS. 9*a* through 9*e*. The axis of contact arm pivot pin 52 is fixed in support 29 and extends through aligned enlarged apertures 99 in contact arm sections 71, 72. In FIG. 9*a*, contacts 26, 27 are shown in their final engaged relationship. Initial opening movement for contact arm 28 takes place about pivot 52 as it is positioned at the upper portion of aperture 99 (FIG. 9*b*). At the outwardly offset portions of contact arm sections 71, 72, each is provided with an ear 98 that is engageable with the upper surface 97 of terminal strap 30. When this engagement occurs, the pivot point for contact arm 28 shifts to ears 98, 98 and the location of pivot 52 within apertures 99 changes (FIG. 9*c*), until in the fully open position of FIG. 9*d*, pin 52 is at the bottom of aperture 99 and adjacent to wall 96 thereof. Pivot 52 remains in this position relative to aperture 99 during the closing motion of contact arm 28 until there is initial engagement between movable contact 27 and stationary contact 26 (FIG. 9*e*). However, there is a continuing downward force being exerted by toggle 34, 35 on drive means 50 which in turn continues to exert a downward force on contact arm 28, causing the latter to pivot slightly about the engaging point between contacts 26 and 27. This causes the opposite end of contact arm 28 to move downward, and in so doing forces aperture wall 96 to ride against pin 52, thereby forcing contact arm 28 to the left with respect to FIG. 9*e* to the final closed position of FIG. 9*a*, thereby causing movable contact 27 to wipe across the upper surface of stationary contact 26.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A circuit breaker including contact means adapted to be blown open by electrodynamic forces generated under severe fault current conditions, said contact means comprising a stationary section including a stationary contact, and a movable section including a movable contact operable into and out of engagement with said stationary contact to respectively close and open said circuit breaker;

said stationary section also including an interior arm, first and second exterior arms disposed outboard of said interior arm along opposite sides thereof, each of said arms having a first end and a second end;

a connecting section electrically connecting said arms together at their said first ends and being co-planar with said interior arm and said exterior arms, a terminal section connecting said exterior arms together at their said second ends and adapted for fixed connection in an external circuit, said stationary contact being mounted to said interior arm at its said second end and being disposed between said terminal section and said connecting section;

said movable section also including a movable arm having said movable contact mounted at one end thereof;

said movable arm extending from said one end toward said connecting section and having its other end adapted for fixed electrical connection in an external circuit;

with said contacts engaged said movable arm confronting said interior arm in closely spaced relationship and said exterior arms being disposed outboard of said movable arm whereby current flow in said interior arm is opposite to current flow in said movable and exterior arms resulting in a strong blowoff effect under severe fault current conditions.

2. A circuit breaker as set forth in claim 1 in which the interior arm has a cross-sectional area substantially equal to the combined cross-sectional areas of said exterior arms.

3. A circuit breaker as set forth in claim 1 in which the interior and exterior arms are closely spaced.

4. A circuit breaker as set forth in claim 1 also including a thin insulator interposed between said movable arm and the others of said arms.

5. A circuit braeker as set forth in claim 4 in which the insulator is provided with a window with which the stationary contact is aligned.

6. A circuit breaker as set forth in claim 5 in which the stationary section also includes an arc runner disposed in close proximity to said stationary contact, said insulator being interposed between said arc runner and said exterior arms.

7. A circuit breaker as set forth in claim 1 in which the interior arm, the exterior arms and the connecting sections are intergrally formed from a single sheet of good electrically conductive material.

8. A circuit breaker as set forth in claim 7 in which side to side spacing between said interior arm and each of said exterior arms is less than the thickness of said single sheet.

9. A circuit breaker as set forth in claim 7 in which the interior arm, the exterior arms and the connecting section are formed by stamping a U-shaped opening in said single sheet.

10. A circuit breaker as set forth in claim 1 in which the terminal section is also integrally formed with said exterior arms.

11. A circuit breaker as set forth in claim 1 also including a housing wherein said contact means is disposed; a line contact and a load contact disposed at opposite ends of said housing; said interior arm being elongated and having its longitudinal axis disposed generally parallel to a line extending between said opposite ends of said housing.

12. A circuit breaker, comprising:

contact means adapted to be blown open by electrodynamic forces generated under severe fault current conditions, said contact means including a stationary section having a stationary contact, and a movable section having a movable contact operable into and out of engagement with said stationary contact to respectively close and open said circuit breaker;

an interior arm supporting the stationary contact thereon;

first and second exterior arms disposed outboard of said interior arm along opposite sides thereof, each of said arms having a first end and a second end;

a connecting section electrically connecting said arms together at their said first ends and being co-planar with said interior arm and said exterior arms;

a terminal section connecting said exterior arms together at their said second ends and adapted for fixed connection in an external circuit, said terminal section along with said interior arm, said exterior arms, and said connecting section being integrally formed from a single sheet of electrically conductive material;

a movable arm mounting said movable contact at one end thereof and extending from said one end toward said connecting section and having its other end adapted for fixed electrical connection in an external circuit;

a thin insulator of generally stiff yet flexible insulating material separating said stationary section and said movable section, with a window aligned with said stationary contact to allow said stationary contact and said movable contact to engage;

with said contacts engaged said movable arm confronting said interior arm in closely spaced relationship and said exterior arms being disposed outboard of said movable arm whereby current flow in said interior arm is opposite to current flow in said movable and exterior arms resulting in a strong net electrodynamic blowoff effect under severe fault current conditions.

* * * * *